US010016878B2

(12) United States Patent
Raimondi

(10) Patent No.: US 10,016,878 B2
(45) Date of Patent: Jul. 10, 2018

(54) PNEUMATICALLY OPERABLE WORK TOOL

(71) Applicant: UNIVER S.P.A., Milan (IT)

(72) Inventor: Stefano Raimondi, Pieve Emanuele (IT)

(73) Assignee: UNIVER S.P.A., Milan (IT)

( * ) Notice: Subject to any disclaimer, the term of this patent is extended or adjusted under 35 U.S.C. 154(b) by 6 days.

(21) Appl. No.: 14/907,700

(22) PCT Filed: Mar. 20, 2015

(86) PCT No.: PCT/EP2015/055901
§ 371 (c)(1),
(2) Date: Jan. 26, 2016

(87) PCT Pub. No.: WO2015/140288
PCT Pub. Date: Sep. 24, 2015

(65) Prior Publication Data

US 2016/0167202 A1 Jun. 16, 2016

(30) Foreign Application Priority Data

Mar. 20, 2014 (EP) ..... 14160861
Apr. 10, 2014 (EP) ..... 14164124

(51) Int. Cl.
*B25B 5/06* (2006.01)
*B25B 5/12* (2006.01)

(52) U.S. Cl.
CPC ..... *B25B 5/122* (2013.01); *B25B 5/064* (2013.01)

(58) Field of Classification Search
CPC ..... B25B 5/122; B25B 5/16; B25B 5/105; B25B 5/064; B25B 5/04; B23Q 11/0875
See application file for complete search history.

(56) References Cited

U.S. PATENT DOCUMENTS 3,027,155 A * 3/1962 Paterson ..... B25B 5/122 269/228
3,347,542 A 10/1967 Mericle, Jr.
(Continued)

FOREIGN PATENT DOCUMENTS

DE 29615157 U1 * 11/1996 ..... B25B 5/122
EP 0928663 A2 * 7/1999 ..... B25B 5/087
(Continued)

OTHER PUBLICATIONS

The International Bureau of WIPO, International Preliminary Report on Patentability and Written Opinion of the International Search Authority (w/ English-Language Translation), Sep. 29, 2016 (Sep. 29, 2016), 14 pages, The International Bureau of WIPO, Geneva, Switzerland.

*Primary Examiner* — Joseph J Hail
*Assistant Examiner* — Arman Milanian
(74) *Attorney, Agent, or Firm* — Christopher C. Dremann, P.C.; Christopher C. Dremann

(57) ABSTRACT

A pneumatically operable work tool for use in body construction in the motor vehicle industry includes a cylinder which has a cylinder housing, a piston moveable therein and a piston rod, which is connected to said piston, moveable linearly and guided out of the cylinder housing, and with a head housing connected to the cylinder housing, wherein a region of the piston rod protruding into the head housing cooperates with at least one toggle lever to pivot an arm assigned to the toggle lever, in particular a gripper arm or clamping arm, wherein this arm is mounted in the head housing and is pivotable between a closed position and an opened position. In the region of its end protruding into the head housing, the piston rod receives a bearing element for the toggle lever, wherein the bearing element is guided in a guide of the head housing in the direction of the longitudinal axis of the piston rod, and the bearing element, at a radial
(Continued)

distance from the longitudinal axis of the piston rod, has a receiver for pivotable mounting of a hinge connector, which in the region of an end facing away from the bearing element is connected pivotably to the arm at a distance from a pivot axis of the arm, wherein the end pivot axes of the hinge connector and the pivot axis of the arm are arranged parallel to each other.

13 Claims, 15 Drawing Sheets

(56) References Cited

U.S. PATENT DOCUMENTS 4,445,676 A * 5/1984 Tunkers ..... B25B 5/061 269/238
4,458,889 A * 7/1984 McPherson ..... B25B 5/122 269/32
4,494,739 A * 1/1985 Valentine ..... B25B 5/062 269/233
4,529,182 A * 7/1985 Valentine ..... B25B 5/122 269/157
4,576,367 A * 3/1986 Horn ..... B25B 5/122 269/228
4,620,696 A * 11/1986 Blatt ..... B25B 5/061 269/135
4,921,233 A * 5/1990 Fabrice ..... B25B 5/166 269/32
5,481,951 A * 1/1996 Kiefer ..... B23Q 1/76 82/162
5,853,211 A * 12/1998 Sawdon ..... B25J 15/0226 294/116
6,056,281 A * 5/2000 Moilanen ..... B25B 5/087 269/237
6,279,886 B1 * 8/2001 Grossart ..... B25B 5/122 269/24
6,428,070 B1 * 8/2002 Takanashi ..... B25B 5/06 294/119.1
6,488,273 B2 * 12/2002 Sawdon ..... B23Q 5/26 269/20
6,997,447 B2 * 2/2006 Fukui ..... B25B 5/122 269/32
8,215,622 B2 * 7/2012 Fukui ..... B25B 5/16 269/20
2002/0029668 A1 * 3/2002 Kroisandt ..... B23Q 1/0036 82/53
2004/0130083 A1 * 7/2004 Moilanen ..... B25B 5/087 269/32

FOREIGN PATENT DOCUMENTS

EP 1277541 A1 * 1/2003 ..... B25B 5/006
EP 2241402 A1 * 10/2010 ..... B25B 5/087
GB 709285 A 5/1954
WO WO 2008015936 A1 * 2/2008 ..... B25B 5/122

* cited by examiner

PNEUMATICALLY OPERABLE WORK TOOL

FIELD OF THE INVENTION

The invention concerns a pneumatically operable work tool for use in body construction in the motor vehicle industry, with a cylinder which has a cylinder housing, a piston moveable therein and a piston rod which is connected to said piston, moveable linearly and guided out of the cylinder housing, and with a head housing connected to the cylinder housing, wherein a region of the piston rod protruding into the head housing cooperates with at least one toggle lever to pivot an arm assigned to the toggle lever, in particular a gripper arm or clamping arm, wherein this arm is mounted in the head housing and is pivotable between a closed position and an opened position.

BACKGROUND OF THE INVENTION AND RELATED ART

Such a work tool is known from DE 296 15 157 U1. Here two toggle levers pivotably grip directly onto the end of the piston rod in the head housing. Two gripper arms are pivotable between a closed position and an opened position. In the closed position, the gripper arms are arranged parallel to each other. A bearing axis arranged in the region of the free end of the piston rod for the two toggle levers is provided at the end with bearing rollers which are guided in guide grooves of the head housing.

Because of the direct connection of the toggle levers to the piston rod, the opening angle of the gripper arms is not adjustable. Also, this design does not allow particularly large opening angles of the gripper arms because the piston rod protrudes into the movement path of the center joint of the toggle lever.

Also, with this work tool the free end of the piston rod is guided via the axis passing through this, which simultaneously forms the bearing axis of the toggle levers. In this work tool, the length of the piston rod is not adjustable. Thus the opening angle of the arms is also not adjustable.

Pneumatically operable work tools with gripper or clamping arms using a piston rod which is not adjustable in length are also known from DE 10 2004 040 606 B3, EP 2 241 402 A1 and US RE 41,223 E.

EP 2 548 700 A1 describes a pneumatically operable work tool in which, in an opened position of a clamping arm, a piston of a cylinder is positioned in the region of a base of the cylinder housing. To be able to adjust the opening angle of the clamping arm, the piston rod is designed adjustable in length and has piston rod parts with threaded positions, wherein the piston rod parts are screwed into each other. By twisting the piston rod part facing the base of the cylinder housing, when the piston is arranged in the region of the base, the length of the piston rod can be changed using means accessible from the outside to turn the piston rod part, and hence the opening angle of the clamping arm can be adjusted continuously.

OBJECTS AND SUMMARY OF THE INVENTION

The object of the present invention is to refine a work tool of the type cited initially so that with a universal design of the connection of piston rod and at least one arrangement of toggle lever and assigned arm, a large swivel angle range and in particular a large opening angle of the arm can be achieved.

This object is achieved by a pneumatically operable work tool which is formed according to the features of the present invention, as shown and described herein.

In one embodiment of a pneumatically operable work tool according to the invention, in the region of its end protruding into the head housing, the piston rod receives a bearing element for the toggle lever. The bearing element is guided in a guide of the head housing in the direction of the longitudinal axis of the piston rod. The bearing element, at a radial distance from the longitudinal axis of the piston rod, has a receiver for pivotable mounting of a hinge connector. In the region of an end facing away from the bearing element, this connector is connected pivotably to the arm at a distance from a pivot axis of the arm. The end pivot axes of the hinge connector and the pivot axis of the arm are arranged parallel to each other.

In another embodiment according to the invention, with the work tool for pivoting the arm assigned to the toggle lever, in particular the gripper arm or clamping arm, the at least one toggle lever is mounted not directly in the piston rod, but instead the bearing element is provided for mounting the toggle lever. This bearing element is configured such that the toggle lever engages on the bearing element at a radial distance from the longitudinal axis of the piston rod. Because of this mounting, the piston rod does not limit the pivot travel of the hinge connector forming part of the toggle lever. The merely indirect mounting of the respective toggle lever in the piston rod, hence the mounting in the bearing element, allows a universal connection to the bearing element such that the bearing element is configured so that it has a receiver to which a hinge connector is connected, or the bearing element on the sides facing away from each other has receivers for pivotable mounting of two hinge connectors. Depending on the design of the work tool, with this embodiment one receiver can remain free, wherein only one of the two receivers receives a hinge connector to which an arm is assigned, or both receivers are fitted with hinge connectors so that the work tool has two arms. Because the bearing element is guided in a guide of the head housing in the direction of the longitudinal axis of the piston rod, forces can be transmitted optimally to the arm or from the arm to the bearing element, irrespective of whether the work tool has one or two arms.

The work tool can thus be configured so that the receivers for pivotable mounting of the two hinge connectors are only provided on the respective side of the bearing element, i.e. to the side of the longitudinal axis of the piston rod. This design allows a structurally simple linking of the two hinge connectors which cooperate with the arms.

If only one arm is present on the work tool, for reasons of standardization of the work tool, the same bearing element can be used throughout, wherein then only one hinge connector is connected to the bearing element for linking to the one arm, while the other receiver of the bearing element does not receive a hinge connector.

If the bearing element receives both hinge connectors, it is considered particularly advantageous if the bearing element, hinge connector and arms are arranged symmetrically to a plane running through the longitudinal axis of the piston rod. This gives a symmetrical design of the work tool in the region of the head housing and the two arms, wherein the gripping or clamping forces introduced into the two arms on contacting of a component assigned to the work tool, for example a body panel, are introduced symmetrically into the work tool.

It is particularly advantageous in another embodiment to guide the bearing element in the guide of the head housing in the direction of the longitudinal axis of the piston rod. This guidance is important not only with regard to the actual guidance of the bearing element in the head housing, but also from the aspect of the application of forces acting on the arm or arms from the bearing element to the head housing. This guided mounting of the bearing element allows the work tool to be designed both in the variant with one arm and in the variant with two arms. In the variant with one arm, forces are introduced into the head housing asymmetrically via the arm. This is easily possible because, due to the guidance of the bearing element in the head housing, the forces are introduced directly into the head housing via the bearing element and its assigned guide.

From a structural aspect and with regard to wear, it is considered particularly advantageous in another embodiment if the bearing element is mounted in a guide in the head housing by means of a plain bearing and/or roller bearing. In particular with a roller bearing, the use of roller bearings in the form of straight or spherical roller bearings is considered advantageous.

The guide has guide surfaces which are in particular parallel to each other and arranged parallel to the pivot axis of the arm.

According to a structurally particularly preferred embodiment, it is provided that the respective receiver has a plate-like shoulder connected to a base body of the bearing element, wherein the shoulder has a hole for receiving a bearing bolt for the assigned hinge connector. Such a design allows simple connection of the hinge connector to the bearing element, with a structurally simple design of this arrangement.

A particularly good guidance of the bearing element with an optimum force application point of the hinge connector or connectors results when, in the axial direction of the piston rod, the bearing element has bearing parts arranged behind each other and spaced apart for mounting the bearing element in the head housing, wherein at least one receiver is arranged between the bearing parts in relation to the axial direction of the piston rod. Because of this design, forces can be transmitted between the bearing element and the hinge connector with a high tilt stability of the bearing element.

The pneumatically operable work tool in particular has a toggle lever for pivoting of an assigned arm, or in particular two toggle levers, wherein each toggle lever serves to pivot an arm assigned to this toggle lever. The arm is in particular a gripper arm.

In the closed position of the arm or arms, the toggle lever or levers is/are arranged in particular in an over-dead-center position. Further pivoting of the respective toggle lever beyond the over-dead-center position is prevented by a buffer which can be arranged arbitrarily and has the purpose of preventing an axial shift of the piston rod, or components cooperating with this piston rod, in the direction of a base of the cylinder housing.

According to another preferred embodiment of the invention, it is provided that in the work tool, the piston rod is not variable in length and in that the opened position of the arm is fully adjustable. Preferably, the piston rod has a threaded portion and in the region of the threaded portion receives a buffer part which is adjustable in the length direction of the piston rod and, in the opened position of this arm, lies on a support that is stationary relative to the head housing, wherein the piston rod is rotatable relative to its longitudinal axis and also relative to the bearing element.

Because of this design of the work tool, the position of the buffer part relative to the piston rod can be changed relative to the axial direction of the piston rod, whereby the opening angle of the arm is fully adjustable by adjustment of the buffer part. At this opening angle, the buffer part contacts the support which is stationary relative to the head housing.

The work tool may be configured such that the cylinder and the head housing constitute separate constructional units or form a common unit.

The buffer part is in particular positioned rotationally fixedly in the head housing. When the piston rod is rotated about its longitudinal axis and thus the position of the buffer part changes relative to the piston rod in the direction of its longitudinal axis, the buffer part is not turned with this and shifts only in the axial direction of the piston rod. This positioning of the buffer part in the head housing may be achieved in various ways, for example by guiding the buffer part in the direction of the longitudinal axis of the piston rod in the head housing, or by a non-round design of the buffer part, wherein the non-round outer contour of buffer part cooperates with a correspondingly designed inner contour of the head housing.

The support which is stationary relative to the head housing may be configured in various ways. The stationary support has the function of forming a bearing surface for the buffer part which, on contact of the buffer part on the stationary support, prevents further axial movement of the buffer part and hence defines the opened position of the arm. In particular, it is provided that the support surface extends orthogonally to the longitudinal axis of the piston rod. Here a contact surface of the buffer part extending orthogonally to the longitudinal axis of the piston rod cooperates with the support surface on contact of the buffer part.

To ensure that the buffer part and piston rod do not shift on operation of the work tool, and hence the opened position of the arm does not shift, it is proposed that thread between the piston rod and the connecting part is self-locking.

It is structurally particularly simple to adjust the position of the buffer part if a base of the cylinder housing facing away from the head housing has means for rotation of the piston rod in the closed position of the arm when the piston is arranged in the region of the base. These means pass through the base in particular and can be shifted preferably in the direction of the longitudinal axis of the piston rod in order to be brought into engagement with the piston rod. It is then possible to turn the piston from outside the cylinder housing. When the buffer part is in the desired set position, the means are brought out of engagement with the piston rod again. This takes place preferably for example on pressurization of the cylinder by the pressure medium.

It is furthermore regarded as advantageous if a base of the cylinder housing facing away from the head housing has means for axially displacing the piston rod in the closed position of the arm when the piston is arranged in the region of the base, in order to move the toggle lever out of the over-dead-center position. These means for axially displacing the piston rod in the closed position of the arm are provided so that, if in the closed position of the arm the supply of fluid to the cylinder fails, the arm can be released fluid-independently from the over-dead-center position of the toggle lever. To achieve this, it is necessary merely to exert a force on the piston rod via the means for axially displacing the piston rod, whereby the piston rod moves slightly axially and the toggle lever is pivoted out of the over-dead-center position. Normally, the pivot angle of the toggle lever from the dead-center position to the over-dead-center position is a fraction of an angular degree, so to move the toggle lever out of the over-dead-center position, it is merely necessary to move the piston rod, using the means for axially displacing the piston rod, by a short distance which corresponds to this slight angle.

It is regarded as particularly advantageous if the means for axially displacing the piston rod comprise the means for turning the piston rod. These means are formed most easily as a tappet which is moveable in the base of the cylinder housing and sealed against the base, and which outside the cylinder housing has a receiver for a tool for turning the tappet, and inside the cylinder housing a receiver for rotationally fixed engagement in a receiver of the facing end of the piston rod. When the tappet is inserted in the piston rod, by application of an impact force on the tappet, the piston rod can be moved axially and hence the toggle lever moved out of the over-dead-center position. Irrespective of this, the purpose of the tappet is to turn the piston about its longitudinal axis when the tappet is turned by means of the tool, and hence to adjust the buffer part relative to the piston rod.

Further other and additional features of the present invention will be readily apparent to and understood by those skilled in the relevant art from the detailed description provided hereinafter, as well as the description of the figures and the figures themselves.

BRIEF DESCRIPTION OF THE DRAWING FIGURES

The accompanying drawing figures depict the present invention with reference to exemplary embodiments, without being restricted thereto and/or limited thereby.

DETAILED DESCRIPTION OF EXEMPLARY EMBODIMENTS OF THE INVENTION

Figure 1:
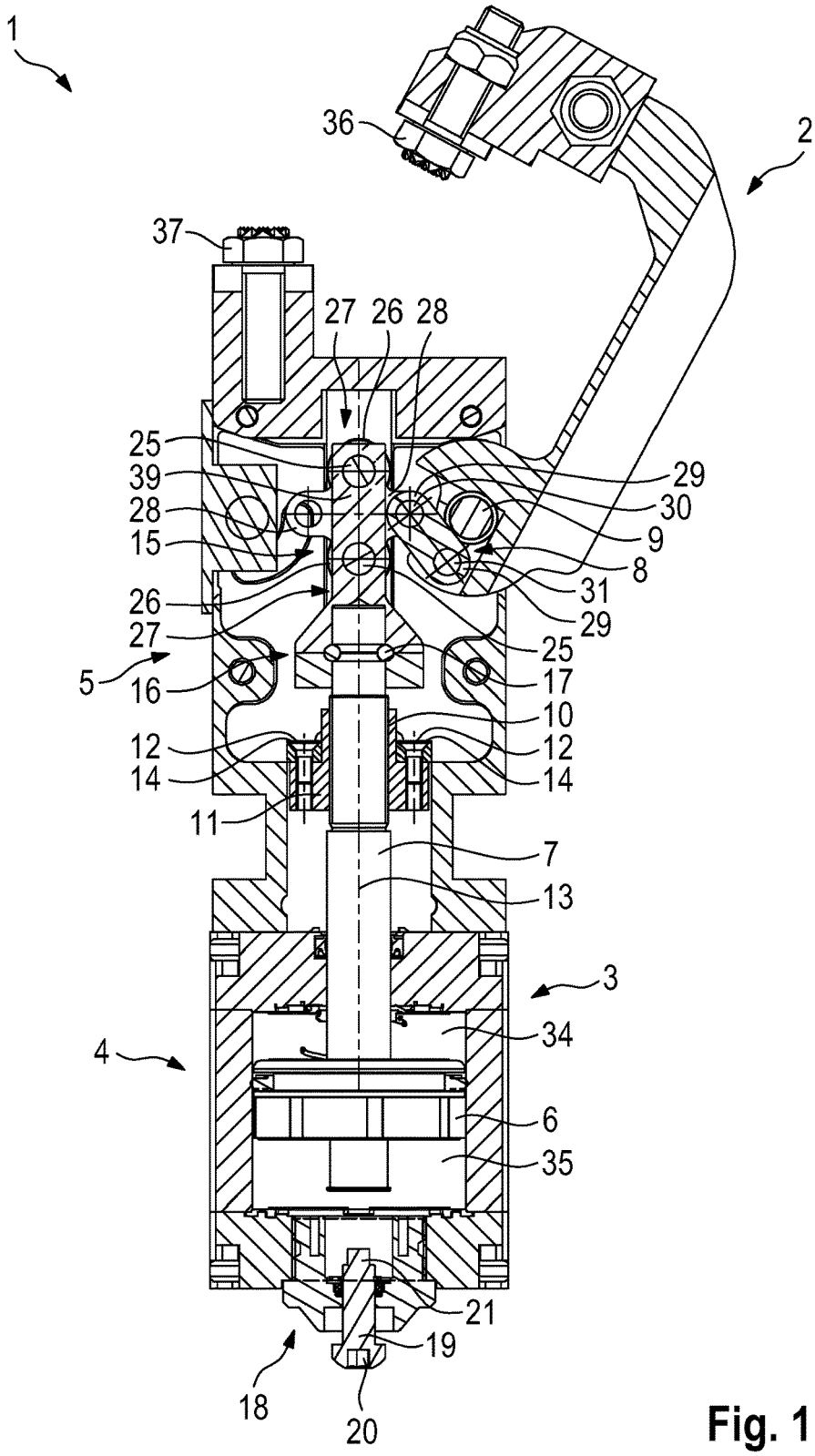
FIG. 1 shows a first exemplary embodiment of a pneumatically operable work tool which has a single arm, illustrated in a section view in a set opened position of 30°.

The drawing figures show a pneumatically operable work tool 1 which is in particular used in body construction in the motor vehicle industry. The work tool 1 as a handling gripper is fitted with a single arm 2 (gripper arm) according to the exemplary embodiment in FIGS. 1 to 7, or with two arms 2 (two gripper arms) according to the exemplary embodiment in FIGS. 7 to 13. Both embodiments have a similar structure. To this extent, initially the first exemplary embodiment will be described with reference to the depiction in FIGS. 1 to 4.

Figure 2:
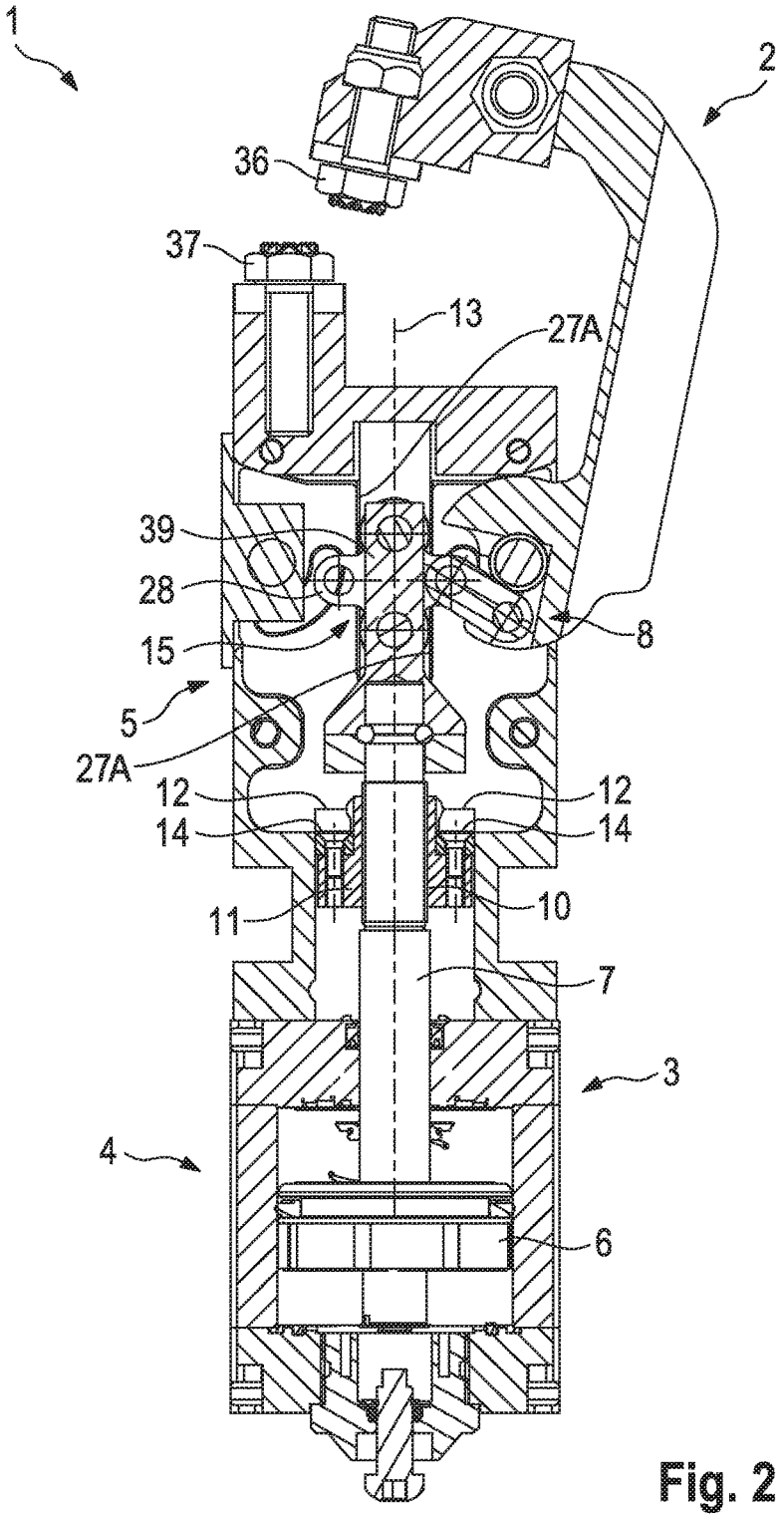
FIG. 2 shows the work tool according to FIG. 1 in an opened intermediate position.
Figure 3:
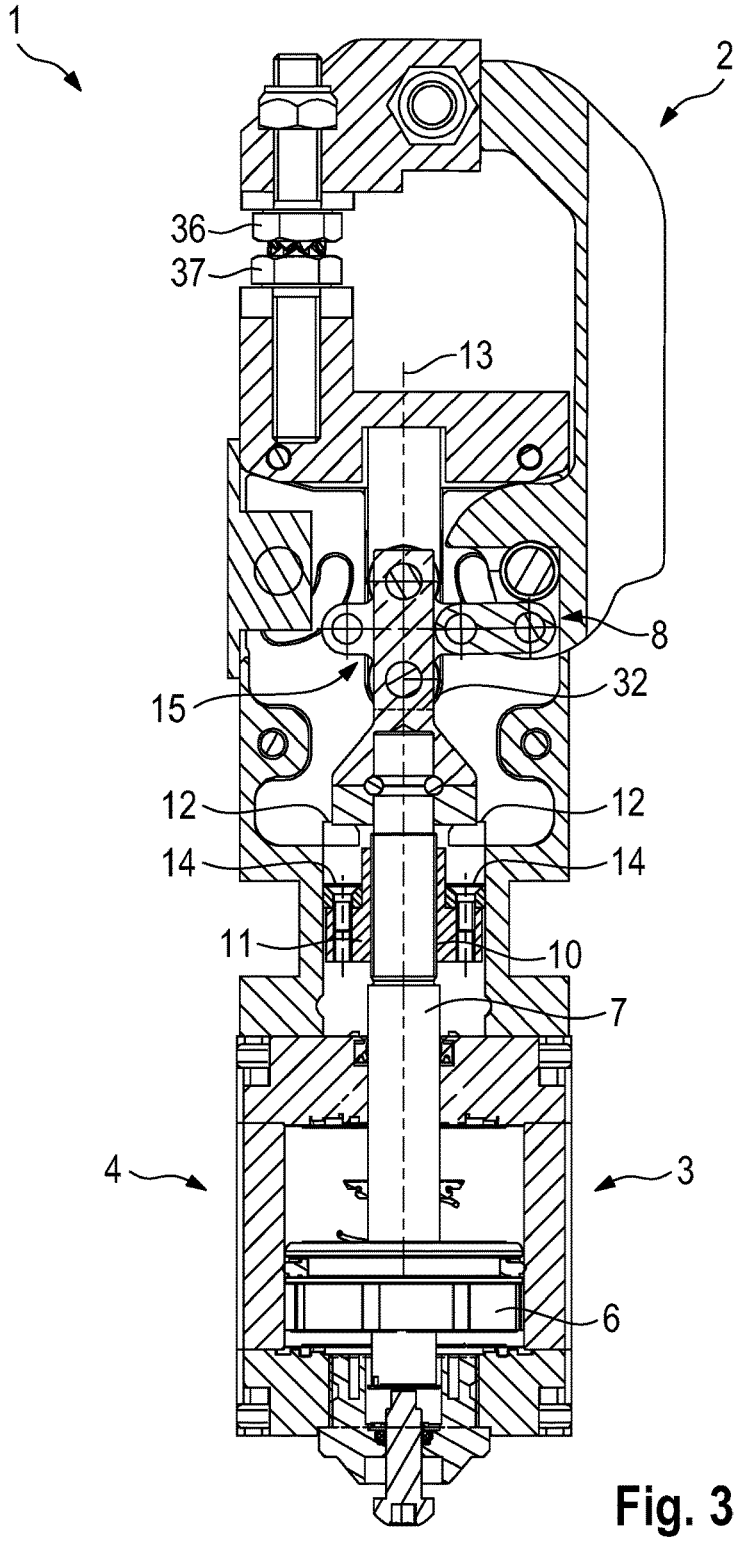
FIG. 3 shows the work tool according to FIGS. 1 and 2 in the closed position.

According to the view in FIGS. 1 to 4, the work tool 1 has a cylinder 3. A head housing 5 is connected to a cylinder housing 4 via fixing means (not shown). The cylinder housing 4 receives a piston 6 displaceable therein, and a piston rod 7 which is connected to said piston, is moveable linearly and guided tightly outside the cylinder housing 4, and is not variable in length. A region of the piston rod 7 protruding into the head housing 5 cooperates with at least one toggle lever 8 for pivoting its assigned arm 2. This arm 2 is mounted in the head housing 5 via an axis 9 and can pivot about this axis 9 between an opened position (FIG. 1) and a closed position (FIG. 3).

The opened position of the arm 2 is fully adjustable. For this, the piston rod 7 has a threaded portion 10 and in the region of this receives a buffer part 11 which is adjustable in the length direction of the piston rod 7. In the opened position of the arm 2, the buffer part 11 lies against a support which is stationary relative to the cylinder housing 4 and formed as an annular support surface 12 of the head housing 5, surrounds the piston rod 7 and is arranged orthogonally to the longitudinal axis 13 of the piston rod 7. The support surface of the buffer part 11, carrying reference numeral 14, is also annular and cooperates with the support surface 12 of the head housing 5. This support surface 14 is arranged parallel to the support surface 12.

The buffer part 11 is positioned rotationally fixedly in the head housing 5, in concrete terms via a groove (not shown) which extends parallel to the longitudinal axis 13 of the piston rod 7 and in which the buffer part 11 engages. The thread in the region of the threaded portion 10 between the piston rod 7 and the buffer part 11 is self-locking.

The piston rod 7 is rotatable relative to its longitudinal axis 13 and, in the region of its end facing the toggle lever 8, receives a bearing element 15 for the toggle lever 8. The piston rod 7 is rotatable about the longitudinal axis 13 relative to the bearing element 15. For this, the piston rod 7 is inserted in a receiver 16 of the bearing element 15 and connected fixedly to the bearing element 15 by means of a form-fit ring 17 in the extension of the longitudinal axis 13.

This connection allows rotation of the piston rod 7 about the longitudinal axis 13 relative to the receiver 16 and hence to the bearing element 15.

Figure 14:
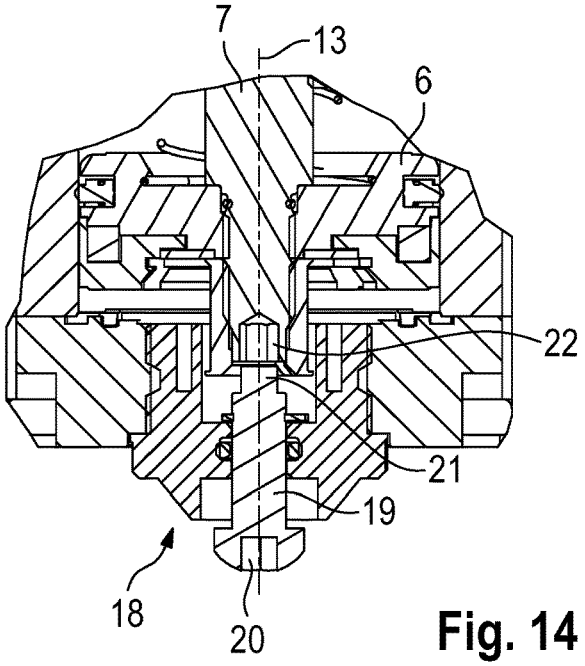
FIG. 14 shows an enlarged section view through the base region of the cylinder when the tappet is not in the active position.
Figure 15:
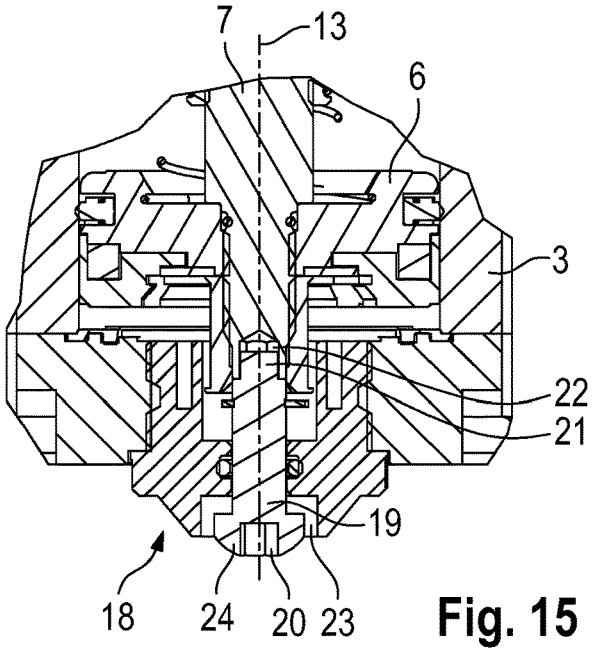
FIG. 15 shows a section view according to FIG. 14 with the tappet in the active position.

A base 18 of the cylinder housing 4 facing away from the head housing 5 has means 19 for turning the piston rod 7 into the closed position (FIG. 3) of the arm 2 when the piston 6 is arranged in the region of the base 18. The means 19 is a tappet which is mounted tightly in the base 18 and is displaceable in the direction of the longitudinal axis 13 of the piston rod 7. The end of the tappet 19 arranged outside the cylinder housing 4 has a hexagonal recess 20 to receive a tool (not shown) for turning the tappet 19 about the longitudinal axis 13, wherein the tool is inserted with a hexagonal end in the hexagonal recess 20. The end arranged inside the cylinder housing 4 has a protrusion 21 with a hexagonal cross section. These details are shown in the view in FIG. 14 with the tappet 19 not engaged. FIG. 15 shows the engagement of the tappet 19, wherein in the closed position of the arm 2, the protrusion 21 is inserted in a recess 22 of hexagonal cross section in the facing end of the piston rod 7. By twisting the tappet 19 using the tool, the piston rod 7 can be turned and consequently the position of the buffer part 11 relative to the piston rod 7 changed. FIG. 15 illustrates that, when the piston rod 7 is in the end position close to the base and the tappet 19 is inserted in the recess 22, an axial gap 23 remains between a head 24 of the tappet 19 and the base 18, so that on application of an external force or impact force on the tappet 19 in the region of its head 24, the tappet 19 is displaced axially, leading to a mechanically induced, axial displacement of the piston rod 7 slightly away from the base 18.

The bearing element 15 is formed symmetrical relative to a plane running through the longitudinal axis 13 of the piston rod 7. Two shafts 25 are mounted in the bearing element 15, wherein the respective shaft 25 receives roller-like bearing elements 26 on both sides of the bearing element 15, which are guided in a bearing groove 27 extending in the direction of the longitudinal axis 13. As shown in FIG. 2, the bearing groove 27 has parallel guide faces 27A which are arranged parallel to the pivot axis 9 of the arm 2. Thus the bearing element 15 is guided substantially play-free in the direction of the longitudinal axis 13. On its sides facing away from each other, the bearing element 15 has plate-like receivers 28 in the form of tabs which are connected to a base body 39 of the bearing element 15. Each receiver 28 is designed to receive a plate-like hinge connector 29 in the region of an axis 30. In the embodiment which has only one arm 2, only one receiver 28 is engaged, while the other receiver 28 remains free. This other receiver 28 is only engaged in the case where a second arm 2 is provided.

In the axial direction 13 of the piston rod 7, the bearing element 15 has roller bearing elements 26 arranged behind each other and spaced apart for mounting the bearing element 15 in the head housing 5. The receiver 28 or the two receivers 28 are arranged between these roller bearing elements 26 relative to the axial direction 13 of the piston rod 7.

In the region of its end facing away from the bearing element 15, the hinge connector 29 is connected pivotably to the arm 2 in the region of an axis 31. This axis 31 is positioned spaced from the axis 9 of the arm 2. The axis 9 and the axes 30 and 31 are arranged parallel to each other. The axes 9, 30 and 31 are constructed such that axes 30 and 31, and 9 and 31, form the toggle levers 8, wherein in the opened position of the arm 2 according to FIG. 1, the connecting line between the axes 30 and 31 forms an angle of less than 90° relative to the connecting line of axes 9 and 31, in relation to their center point, whereas in the closed position of the arm 2 according to FIG. 3, this angle is slightly greater than 90° so that a slight over-dead-center position results in which the bearing element 15 is fixed in the direction of the longitudinal axis 13 and in the direction of the piston rod 7, wherein the roller bearing elements 26 on the piston rod side, in the region of the end of the bearing groove 27 facing the piston rod, lie at the end 32 of the bearing groove 27.

Figure 16:
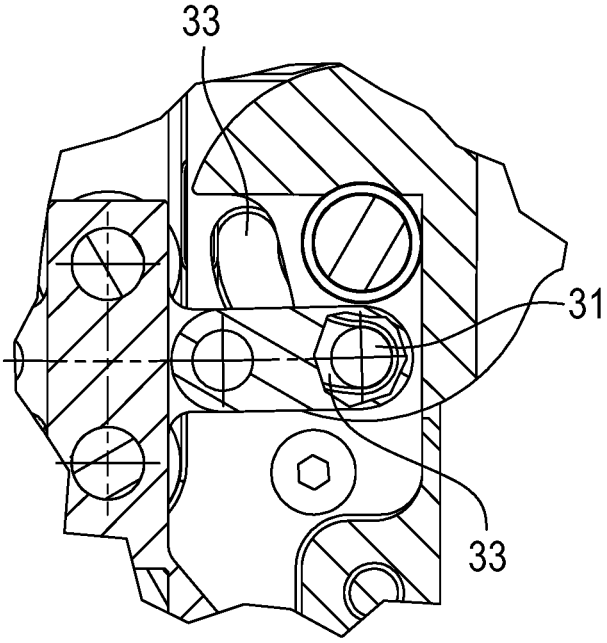
FIG. 16 shows an enlarged section view of the connection of the bearing element to an arm.

FIG. 16 shows the detail of the mounting of the hinge connector 29 in the arm 2. Here the axis 31 is extended and engages in a guide groove 33 of the head housing 5 extending substantially over a quarter circle.

The function of the work tool 1 according to the exemplary embodiment shown in FIGS. 1 to 4 is as follows:

The cylinder housing 4 is divided by the piston 5 into two working chambers 34 and 35 of the fluid. Starting from an opened position of the arm 2 at 30° relative to the longitudinal axis 13, in which the arm 2 is in the maximum opened position relative to the set position of the buffer part 11, in the known manner the working chamber 34 is pressurized with fluid so that the piston 6 is moved in the direction of the base 18. Here the buffer part 11 in the region of its support surface 14 comes out of contact with the support surface 12 of the head housing 5. The piston 6 and the piston rod 7 draw the bearing element 15 with them and via the toggle lever 8, the arm 2 moves with its gripper element 36 arranged in the region of the free end of the arm 2 in the direction of a gripper element 37 mounted in the head housing 5. The intermediate position is shown in FIG. 2.

On further movement of the piston 6, this finally reaches its end position close to the base 18 in which the two gripper elements 36 and 37 make contact and a metal sheet arranged between them is gripped by the gripper elements 36 and 37. When the arm 2 is closed, the toggle lever 8 is in a slightly over-dead-center position in which the connecting line of the two axes 30 and 31, relative to their center point, is arranged at an angle of slightly not equal to 90° to the longitudinal axis 13 of the piston rod 7, such that the center point of the axis 30 is arranged slightly closer to the base 18 than the center point of the other axis 31. Since a stop position is also formed in this closed position of the arm 2, in which the roller bearing elements 26 on the piston rod side lie at the end 32 of the guide groove 33, the toggle lever 8 can only be moved out of this over-dead-center position by active pressurization of the other working chamber 35, into the fully opened position according to FIG. 1 when the buffer part 11 is supported on the head housing 5.

If the fluid supply to the work tool 1, in particular to the working chamber 35, has failed, this over-dead-center position of the toggle lever 8 can only be released by the previously described mechanical action on the tappet 19. Here, via the axial displacement of the piston rod 7 and hence the corresponding axial displacement of the bearing element 15, the hinge connector 29 is pivoted slightly so that the center point of the axis 30 is further away from the base 18 than the center point of the axis 31. In this position, a pivoting of the arm 2 is mechanically possible when the arm 2 is held.

As explained above in relation to the depiction of FIGS. 14 and 15 in particular, the position of the buffer part 11 can be changed by turning the piston rod 7. The tappet 19 is inserted in the recess 22 of the piston rod 7. On pressurization of the cylinder 3 to transfer the piston 6 from the closed position of the work tool, the tappet 19 is moved back, wherein pressure medium is supplied to the working chamber 35 and also acts on the facing end of the tappet 19. On mechanical actuation of the tappet 19 to transfer the toggle lever 8 from the over-dead-center position, the subsequent return movement of the tappet 19 also takes place because of the pressure medium supplied to the working chamber 35 (after the pressure medium has been made available again).

Figure 4:
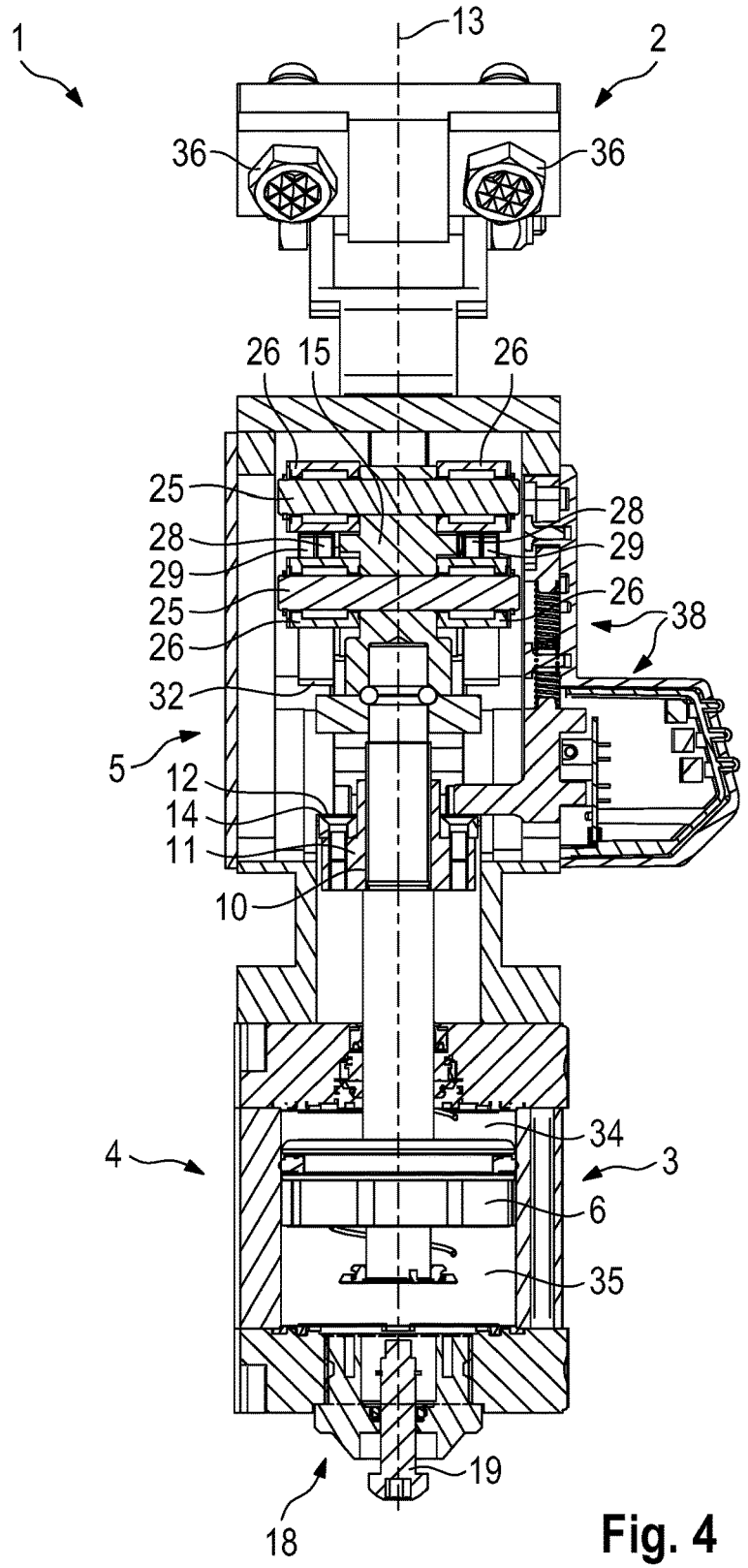
FIG. 4 shows the first exemplary embodiment of the work tool in a section through a piston rod axis of the work tool, perpendicular to the section view in FIGS. 1 to 3, illustrating a modified set opened position.

In FIG. 4, reference numeral 38 designates a sampling device which is mounted in the head housing 5 and serves to sample the position of the bearing element 15 or buffer part 11.

Figure 5:
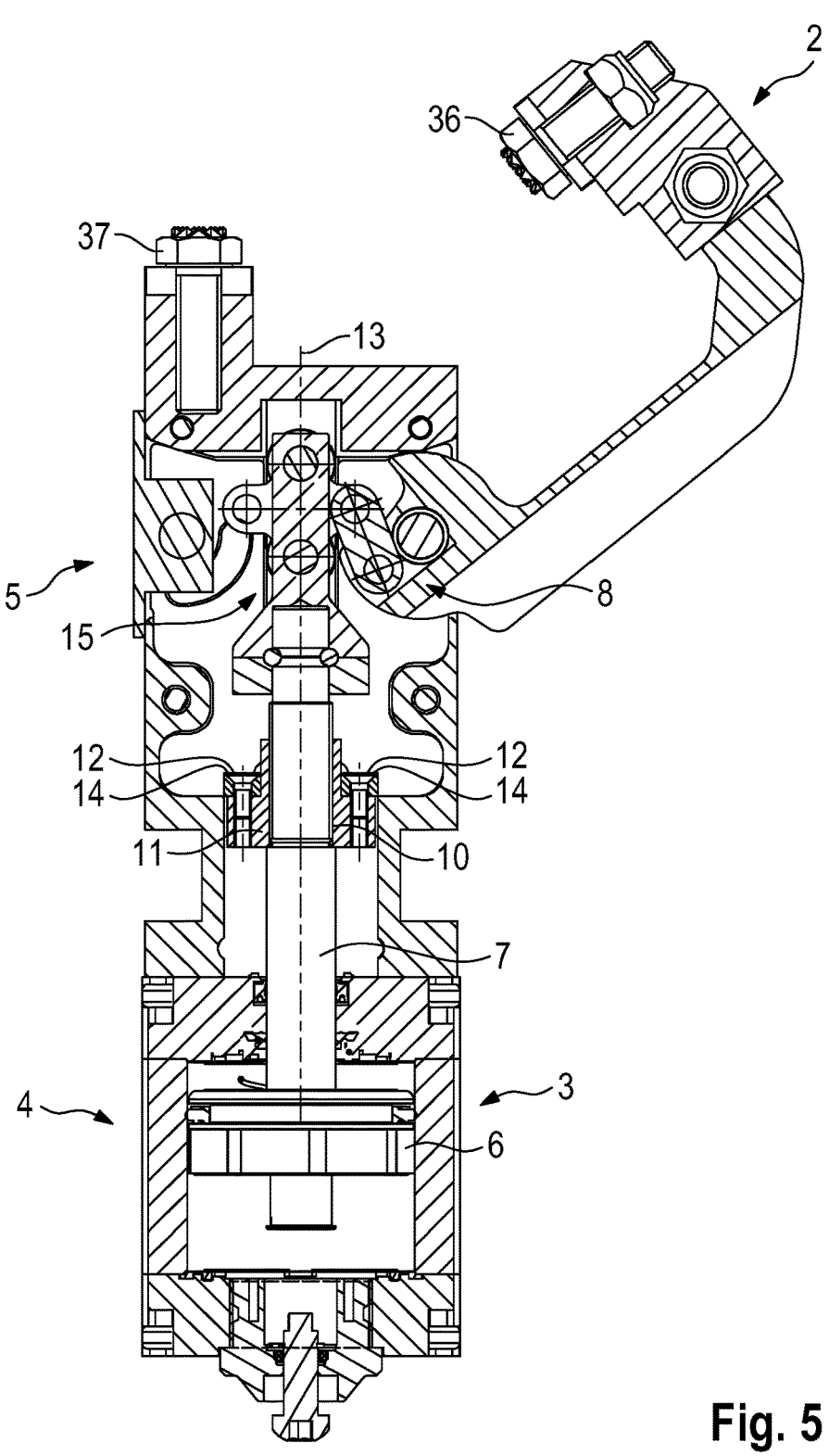
FIG. 5 shows the first exemplary embodiment of the work tool illustrating a set opened position of 50°.
Figure 6:
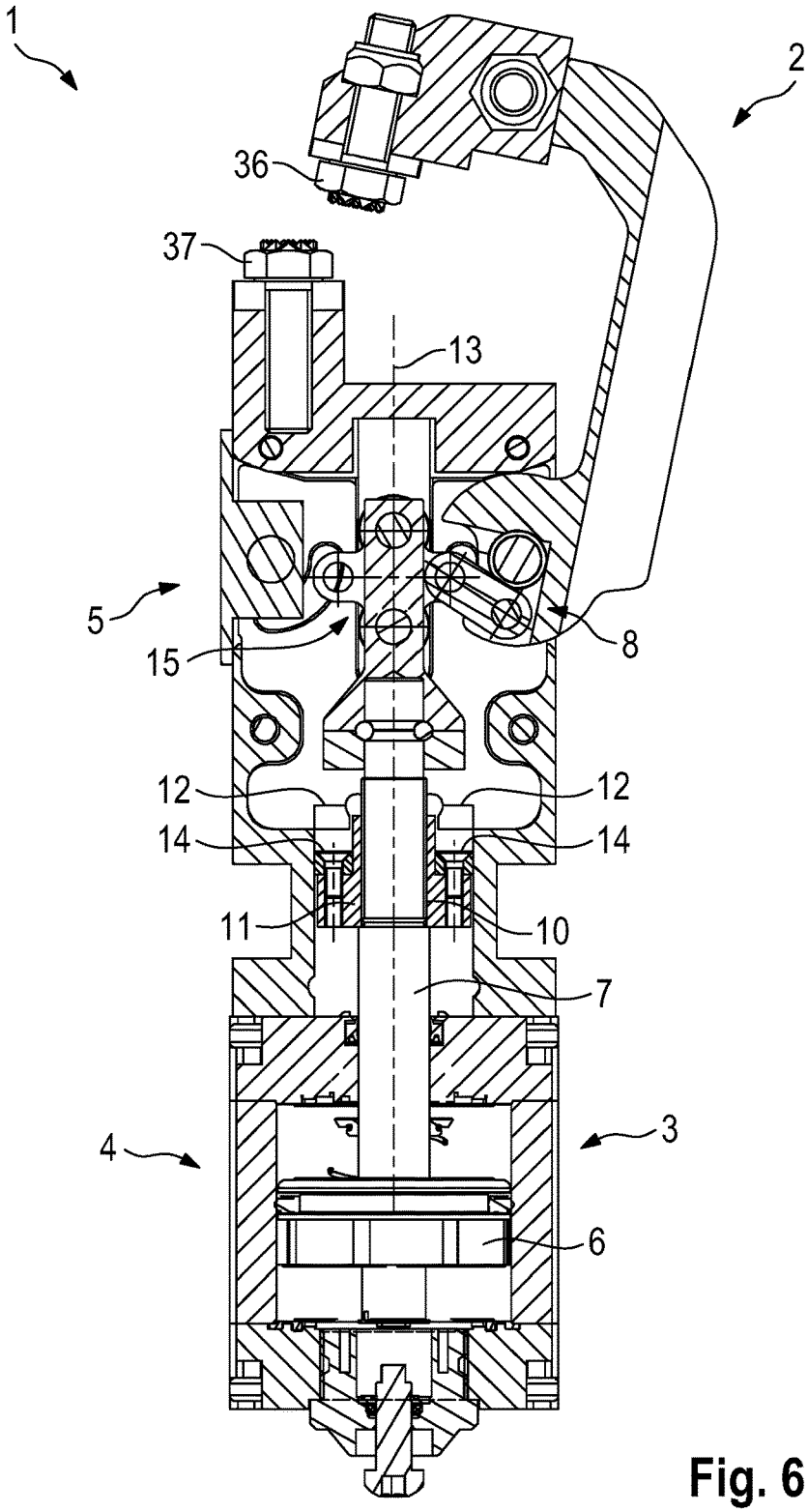
FIG. 6 shows the work tool according to FIG. 5 in an intermediate opened position.
Figure 7:
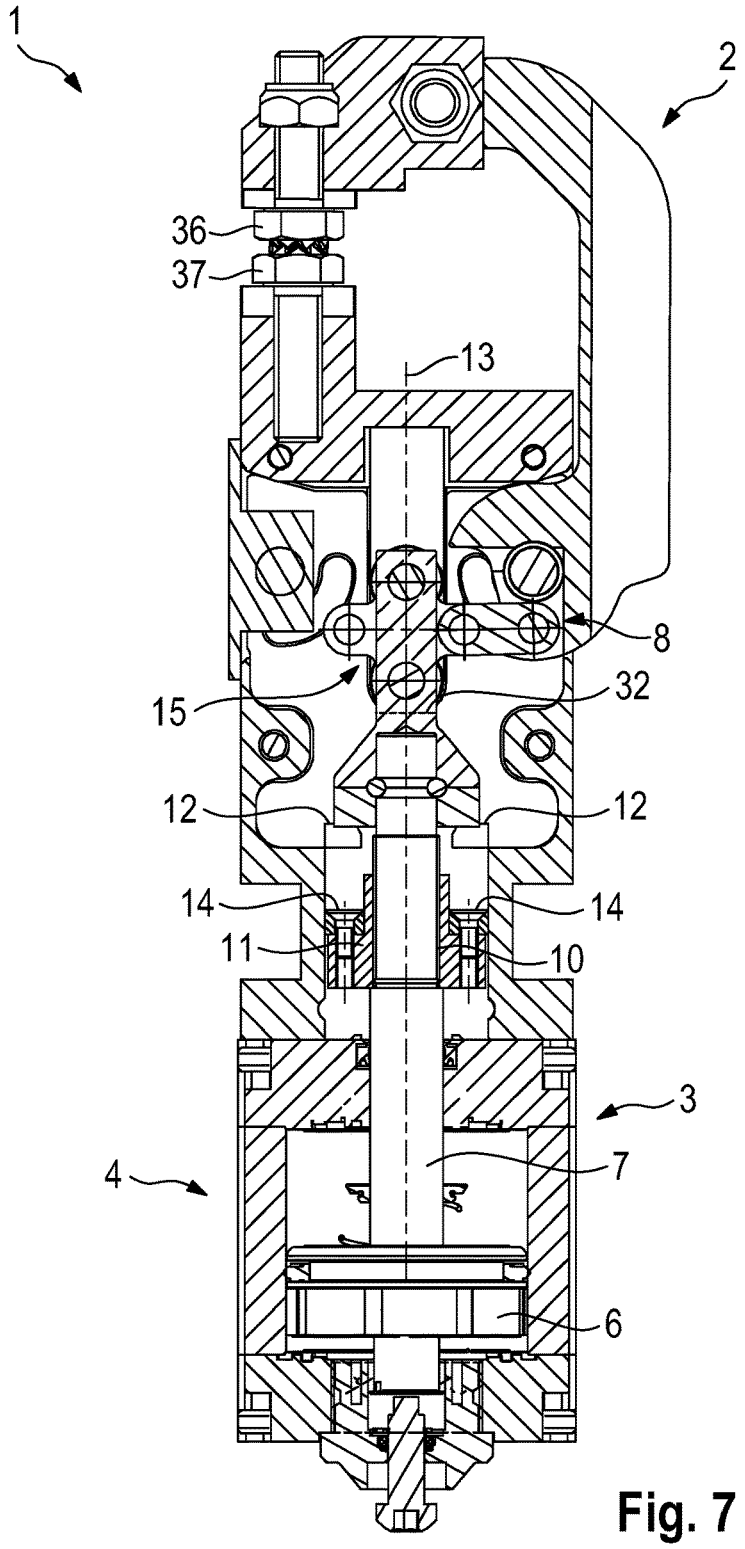
FIG. 7 shows the work tool according to FIGS. 5 and 6 in the closed position.

FIGS. 5 to 7 show the operating states described above for FIGS. 1 to 4 for a work tool 1 with a changed opening angle, with an opening angle of 50°. This position clearly results for example because, with the arm 2 closed, the support surface 12 and the support surface 14 have a different distance from each other, wherein the change of distance corresponds to the change in position of the buffer part 11 relative to the piston rod 7.

The exemplary embodiment in FIGS. 8 to 13 largely corresponds to that of FIGS. 1 to 7. To avoid repetition, reference is made to the detailed description of the first exemplary embodiment.

In the exemplary embodiment according to FIGS. 8 to 13, instead of one arm 2, two arms 2 are provided. The second arm is connected in the same way as the first arm according to the first exemplary embodiment, wherein the bearing element 15, hinge connectors 29 and arms 2 are arranged symmetrically to the plane running through the longitudinal axis 13 of the piston rod 7. To this extent, reference is made to the description above concerning the connection of the one arm 2.

The second exemplary embodiment differs from the first exemplary embodiment in that the respective arm 2 is modified and, in addition, the gripper element 37 is part of the second arm 2.

Figure 8:
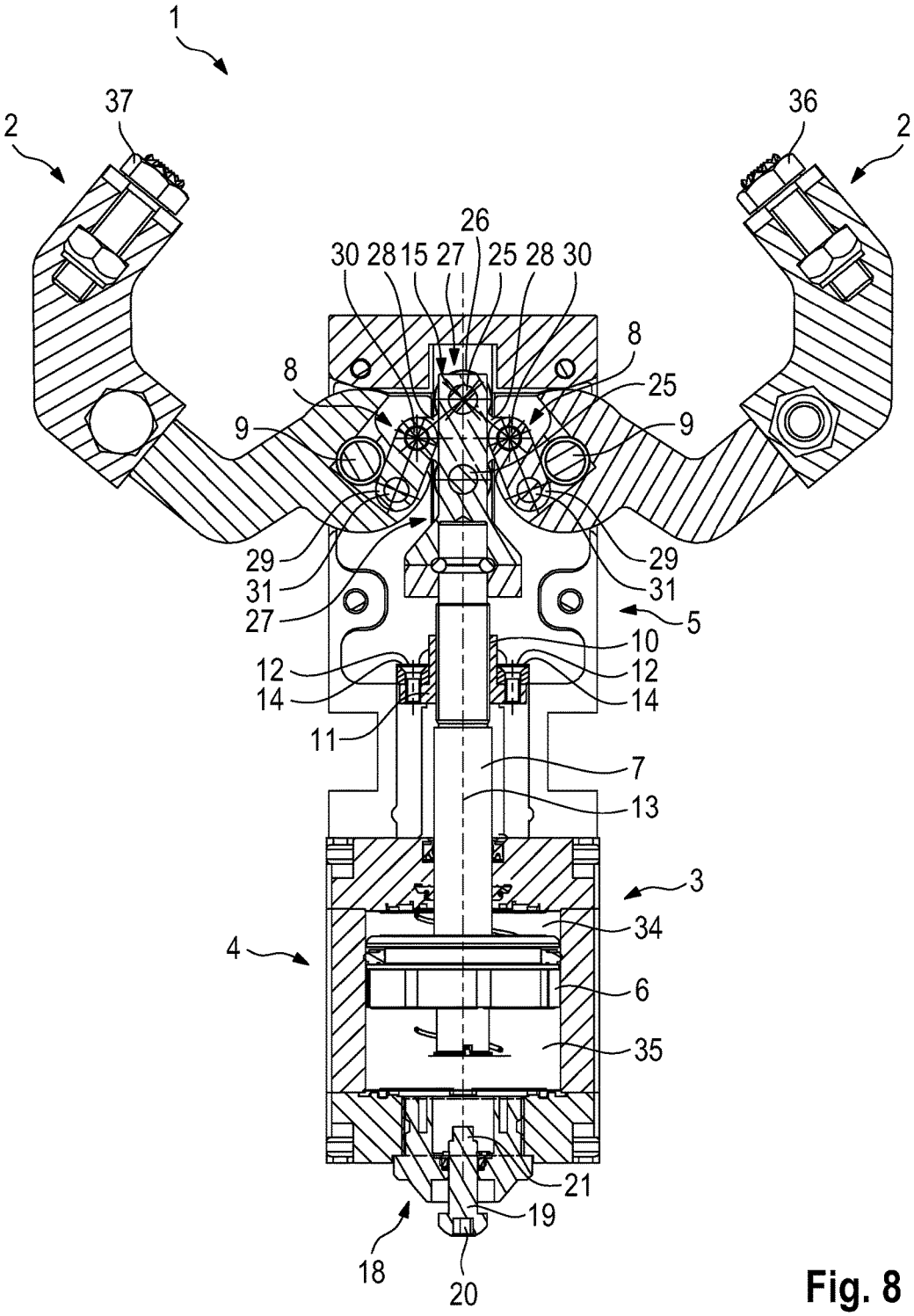
FIG. 8 shows a second exemplary embodiment of a pneumatically operable work tool which has two arms, illustrated in a section view at a set opened position of 90°.
Figure 9:
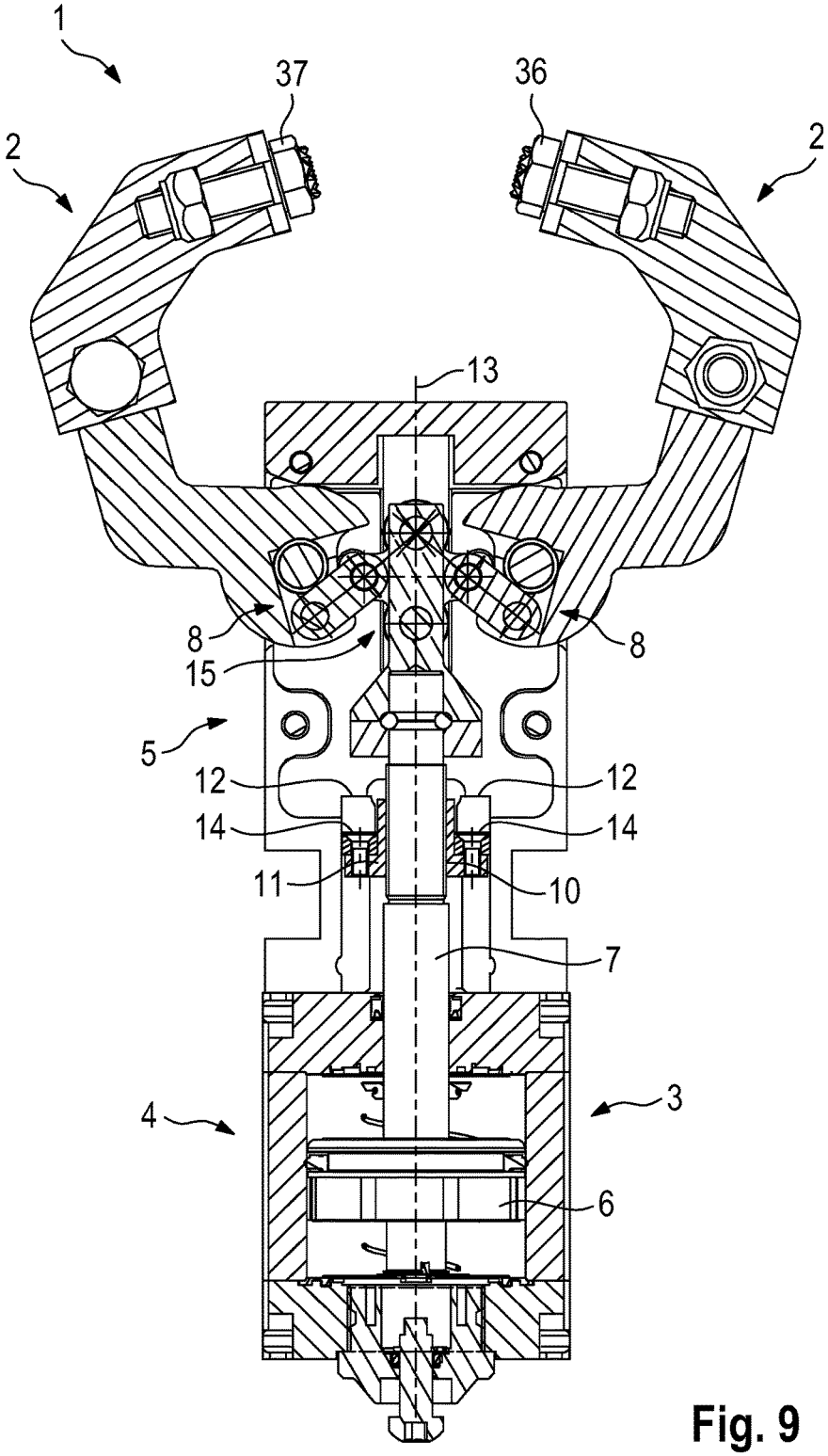
FIG. 9 shows the work tool according to FIG. 8 in an intermediate opened position.
Figure 10:
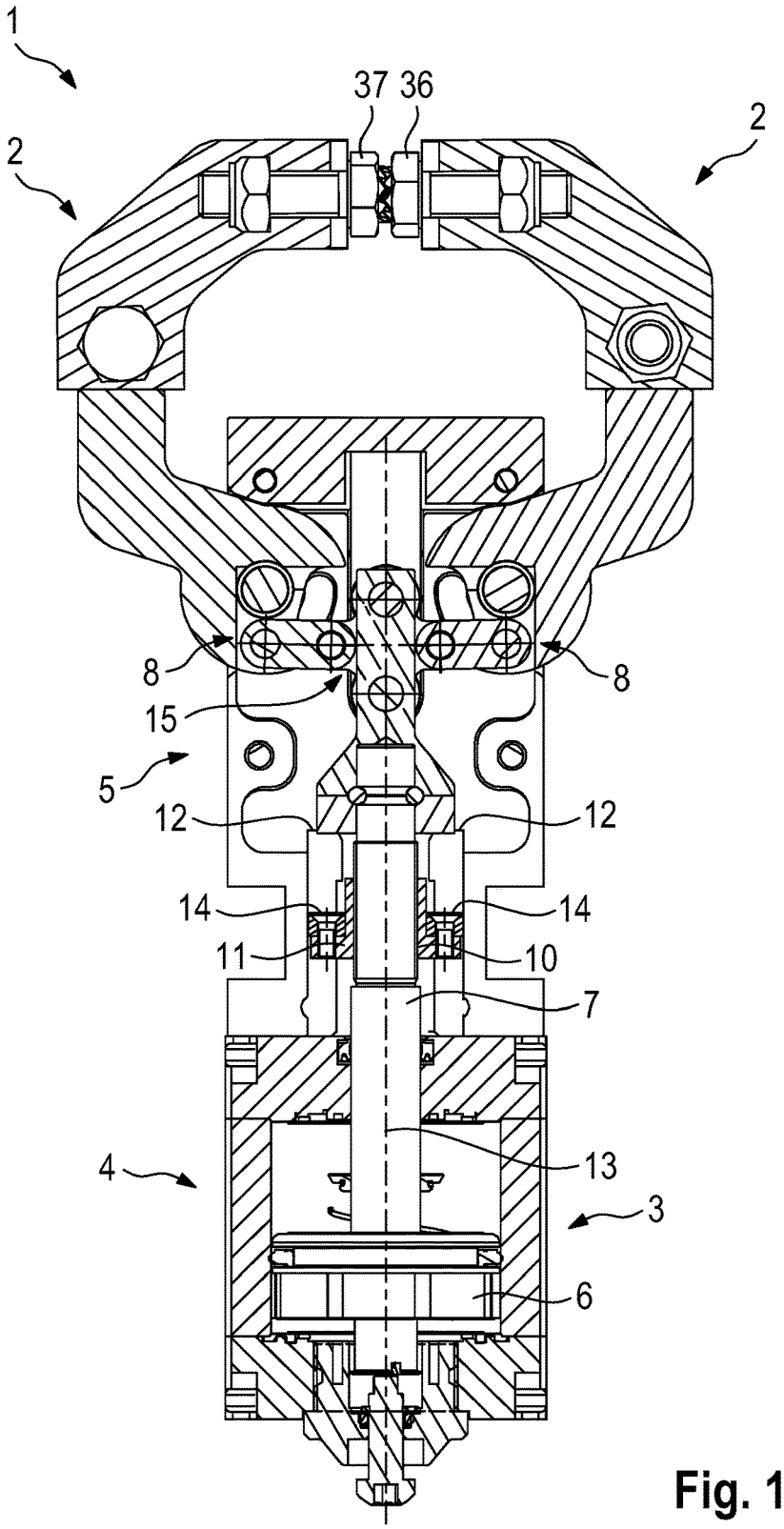
FIG. 10 shows the work tool according to FIGS. 8 and 9 in the closed position.

FIG. 8 shows the work tool 1 with the two arms 2 in an opened position of 90°, FIG. 9 shows the intermediate position and FIG. 10 the closed position, in which the two gripper elements 36 and 37 make contact with each other.

Figure 11:
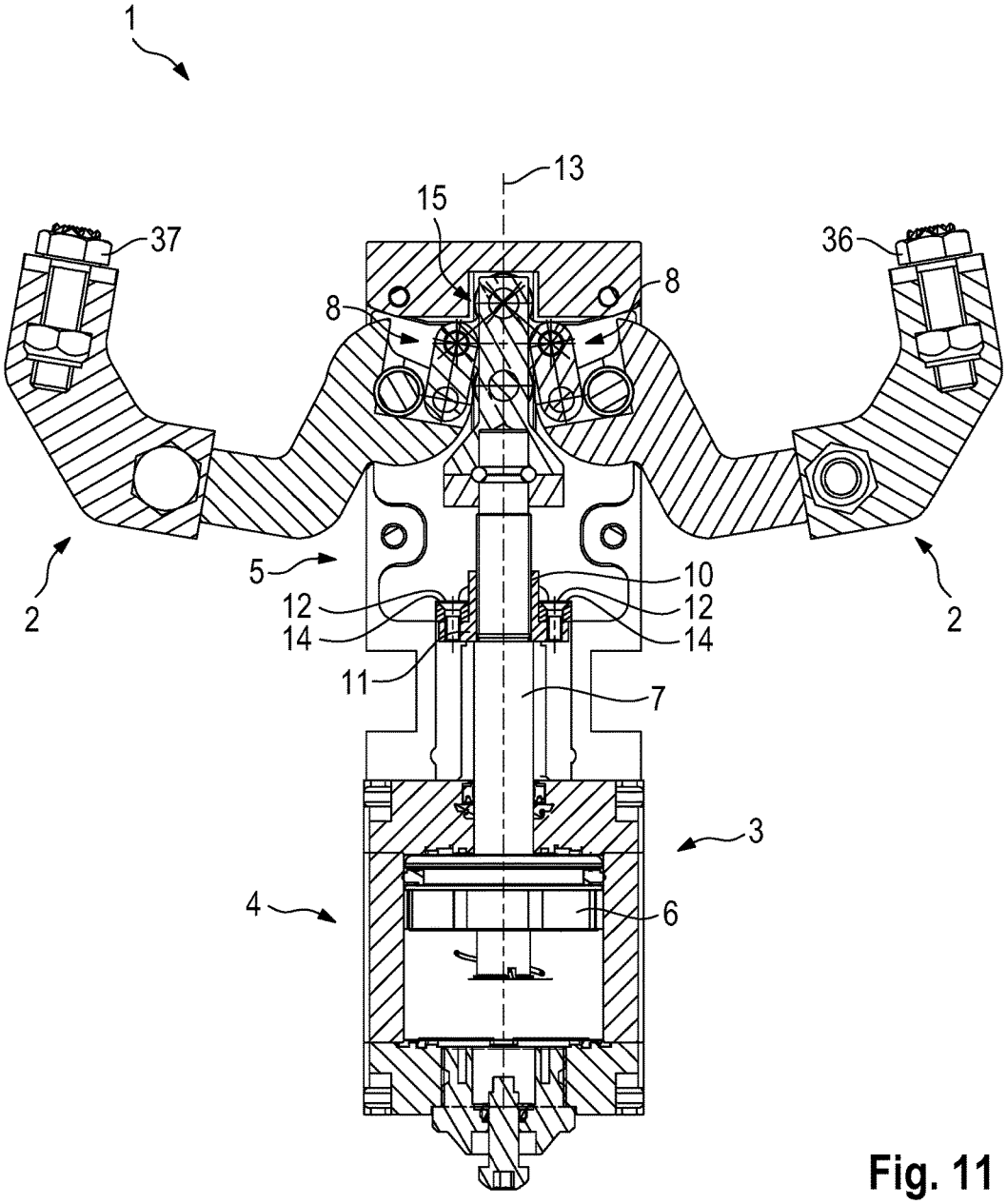
FIG. 11 shows the second exemplary embodiment of the work tool illustrating the set opened position of 160°.
Figure 12:
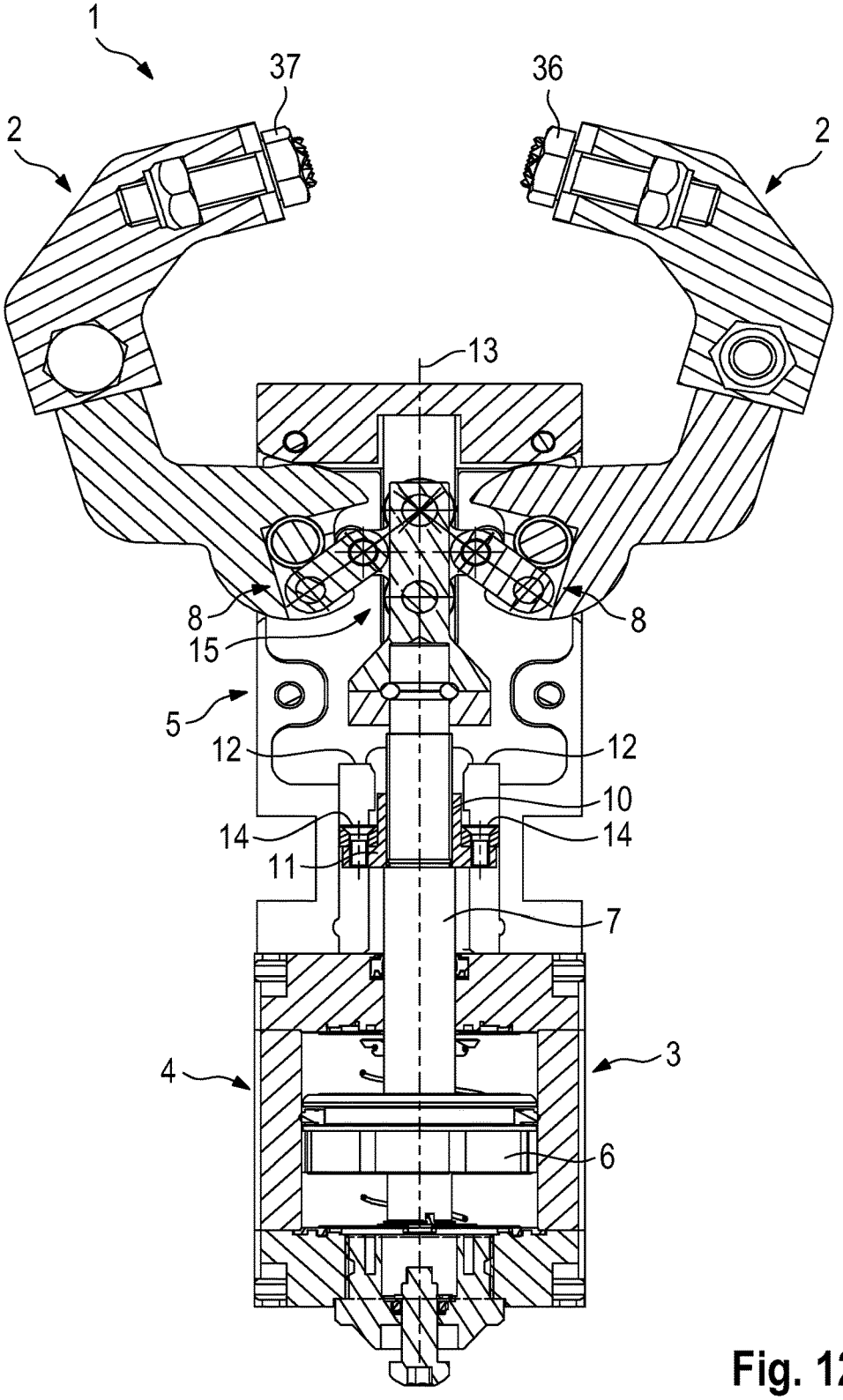
FIG. 12 shows the work tool according to FIG. 11 in an intermediate opened position.
Figure 13:
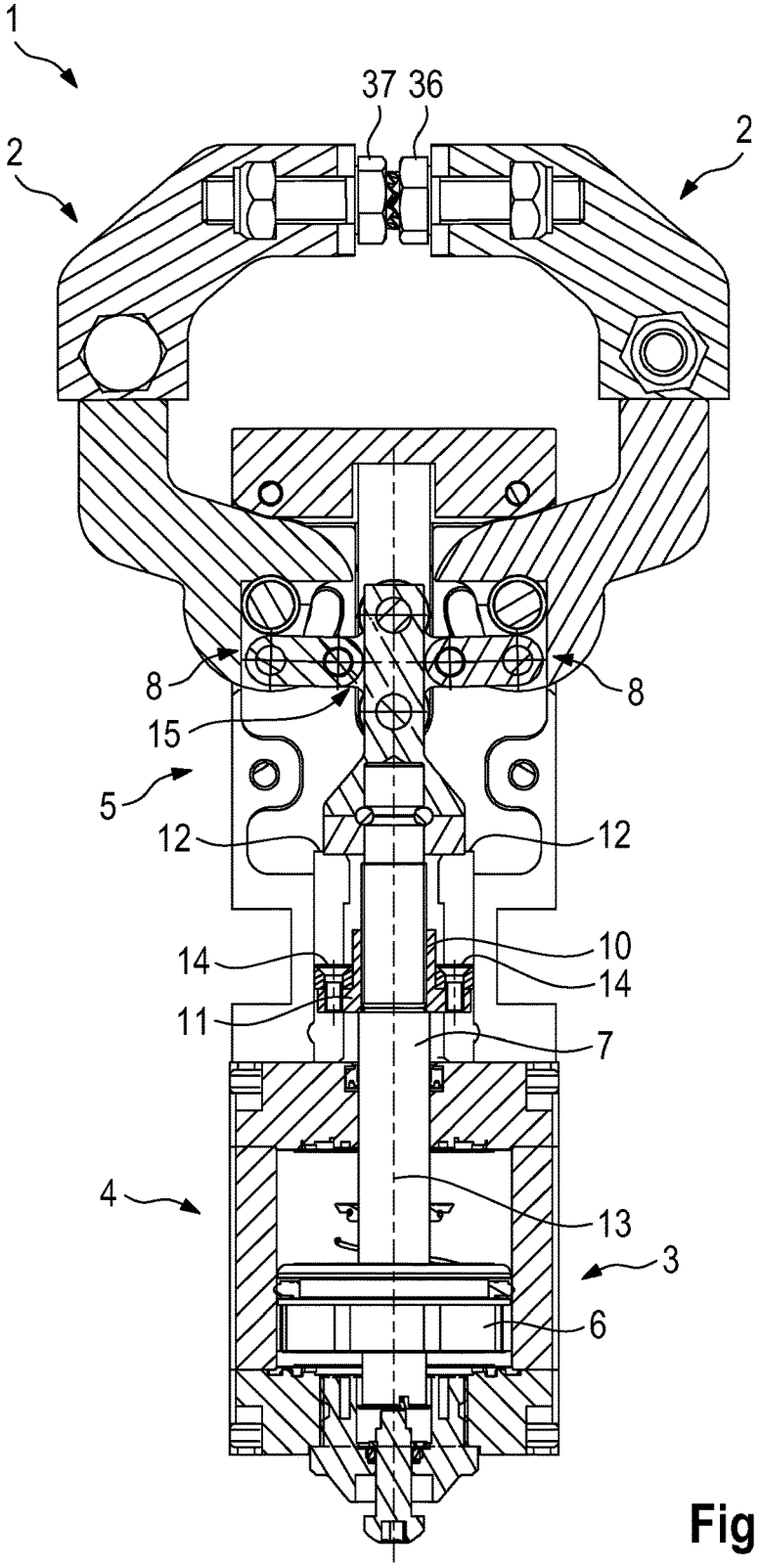
FIG. 13 shows the work tool according to FIGS. 11 and 12 in the closed position.

For the design of the work tool 1 with two arms 2, FIG. 11 shows a different position of the buffer part 11, giving an opened position of 160° according to FIG. 11, FIG. 12 shows the intermediate position and FIG. 13 the closed position.

The two exemplary embodiments illustrate that, by simple conversion or supplementing of the work tool 1, this can be converted to the variant with one arm 2 or two arms 2. It is merely necessary, starting from the variant with one arm 2, to use a modified head housing 5 which has no receiver for the gripper element 37 and instead, in a modified head housing 5, mount the two arms 2 via the toggle lever 8 and connect them to the bearing element 15.

That which is claimed is:

1. A pneumatically operable work tool, with a cylinder which has a cylinder housing, a piston moveable therein and a piston rod which is connected to said piston, moveable linearly and guided out of the cylinder housing, and with a head housing connected to the cylinder housing, wherein a region of the piston rod protruding into the head housing cooperates with at least one toggle lever to pivot an arm assigned to the toggle lever, wherein the arm is mounted in the head housing and is pivotable between a closed position and an opened position, wherein in the region of an end of the piston rod protruding into the head housing, the piston rod receives a bearing element for the toggle lever, wherein the bearing element is guided in a guide of the head housing in the direction of a longitudinal axis of the piston rod, and the bearing element, at a radial distance from the longitudinal axis of the piston rod, has a receiver for pivotable mounting of a hinge connector, which in the region of an end of the hinge connector facing away from the bearing element is connected pivotably to the arm at a distance from a pivot axis of the arm, wherein a pair of end pivot axes of the hinge connector and the pivot axis of the arm are arranged parallel to each other, wherein a base of the cylinder housing facing away from the head housing has a tappet configured for engaging a facing end of the piston rod and for rotation of the piston rod in the closed position of the arm when the piston is arranged in the region of the base.

2. The work tool as claimed in claim 1, wherein a single toggle lever is provided for pivoting an assigned arm, or two toggle levers are provided for pivoting an assigned arm and each of the toggle levers serves to pivot a respective arm.

3. The work tool as claimed in claim 2, wherein the bearing element has two recesses for pivotable mounting of two hinge connectors, wherein the two hinge connectors, in the region of the ends of the hinge connectors facing away from the bearing element, are connected pivotably to the two arms at a distance from the pivot axes of the arms, and wherein the pivot axes of the hinge connectors and the pivot axes of the arms are arranged parallel to each other.

4. The work tool as claimed in claim 3, wherein the bearing element, the hinge connectors and the arms are arranged symmetrically to a plane running through the longitudinal axis of the piston rod.

5. The work tool as claimed in claim 3, wherein the respective receiver has a plate-like shoulder connected to a base body of the bearing element, and wherein the shoulder has a hole for receiving a bearing bolt for engagement with the respective hinge connector.

6. The work tool as claimed in claim 1, wherein in the axial direction of the piston rod, the bearing element has bearing parts arranged behind each other and spaced apart for mounting the bearing element in the head housing, and wherein at least one receiver is arranged between the bearing parts in relation to the axial direction of the piston rod.

7. The work tool as claimed in claim 1, wherein the bearing element is mounted in the guide of the head housing by means of a plain bearing or a roller bearing.

8. The work tool as claimed in claim 1, wherein the guide has parallel guide faces which are arranged parallel to the pivot axis of the arm.

9. The work tool as claimed in claim 1, wherein the tappet is configured for axially displacing the piston rod in the closed position of the arm when the piston is arranged in the region of the base, in order to move the toggle lever out of an over-dead-center position.

10. A pneumatically operable work tool, with a cylinder which has a cylinder housing, a piston moveable therein and a piston rod which is connected to said piston, moveable linearly and guided out of the cylinder housing, and with a head housing connected to the cylinder housing, wherein a region of the piston rod protruding into the head housing cooperates with at least one toggle lever to pivot an arm assigned to the toggle lever, wherein the arm is mounted in the head housing and is pivotable between a closed position and an opened position, wherein in the region of an end of the piston rod protruding into the head housing, the piston rod receives a bearing element for the toggle lever, wherein the bearing element is guided in a guide of the head housing in the direction of a longitudinal axis of the piston rod, and the bearing element, at a radial distance from the longitudinal axis of the piston rod, has a receiver for pivotable mounting of a hinge connector, which in the region of an end of the hinge connector facing away from the bearing element is connected pivotably to the arm at a distance from a pivot axis of the arm, wherein a pair of end pivot axes of the hinge connector and the pivot axis of the arm are arranged parallel to each other, wherein the piston rod is not variable in length and the opened position of the arm is adjustable, wherein the piston rod has a threaded portion and in the region of the threaded portion receives a buffer part which is adjustable in the direction of the longitudinal axis of the piston rod and, in the opened position of the arm, lies on a support face that is stationary relative to the head housing, wherein a tappet engages a facing end of the piston rod such that the piston rod is rotatable relative to the longitudinal axis, and wherein the piston rod is rotatable relative to the bearing element.

11. The work tool as claimed in claim 10, wherein the buffer part is positioned rotationally fixedly in the head housing.

12. The work tool as claimed in claim 10, wherein the stationary support face is formed as a support face of the head housing.

13. The work tool as claimed in claim 10, wherein in the closed position of the arm, the toggle lever is arranged in an over-dead-center position.

* * * * *